US005720256A

United States Patent [19]

Furuya et al.

[11] Patent Number: 5,720,256

[45] Date of Patent: Feb. 24, 1998

[54] APPARATUS AND METHOD FOR CONTROLLING IDLE ROTATION SPEED LEARNING OF AN INTERNAL COMBUSTION ENGINE

[75] Inventors: Junichi Furuya; Yoshihiro Okada; Tooru Kitayama, all of Atsugi, Japan

[73] Assignee: Unisia Jecs Corporation, Kanagawa-ken, Japan

[21] Appl. No.: 752,420

[22] Filed: Nov. 19, 1996

[30] Foreign Application Priority Data

Nov. 20, 1995 [JP] Japan ..... 7-301493

[51] Int. Cl.[6] ..... F02D 43/04

[52] U.S. Cl. ..... 123/339.12; 123/339.22

[58] Field of Search ..... 123/339.12, 339.19–339.23

[56] References Cited

U.S. PATENT DOCUMENTS 5,228,421 7/1993 Orzel ..... 123/339.12

FOREIGN PATENT DOCUMENTS 62-7962 1/1987 Japan .

62-129544 6/1987 Japan .

5-202815 8/1993 Japan .

*Primary Examiner*—Andrew M. Dolinar

*Attorney, Agent, or Firm*—Lowe, Price, LeBlanc & Becker

[57] ABSTRACT

When conditions for purging fuel vapor from a canister, and conditions for learning an idle rotation speed materialize together, then purge concentration is computed. If the purge concentration is low, purge is prohibited, and learning is carried out, while if the purge concentration is high, learning is prohibited and purge is carried out. In this way, erroneous learning due to carrying out purge during learning can be avoided, and the opportunity for purging can be maintained.

10 Claims, 5 Drawing Sheets

APPARATUS AND METHOD FOR CONTROLLING IDLE ROTATION SPEED LEARNING OF AN INTERNAL COMBUSTION ENGINE

FIELD OF THE INVENTION

The present invention relates to an apparatus and method for an internal combustion engine for controlling the learning of a control value for an intake air flow rate for making an idle rotation speed become a target rotation speed. In particular, the invention relates to technology for controlling learning in the case where fuel vapor treatment is carried out at the time of idling.

DESCRIPTION OF THE RELATED ART

An apparatus for controlling the idle rotation speed of an internal combustion engine is disclosed for example in Japanese Unexamined Patent Publication No. 62-129544. With this apparatus, an auxiliary air passage is provided for bypassing a throttle valve disposed in the engine intake system, and a solenoid type idle control valve is provided in the auxiliary air passage. The opening of this idle control valve is controlled so as to control the intake air flow rate, with feedback control being carried out so that the actual idle rotation speed approaches a target rotation speed.

With such an apparatus for controlling the idle rotation speed, a control value to give the target rotation speed changes from an initial value, due for example to engine friction and variations in the gap between the throttle valve and the intake passage wall, and due to deterioration with time. Therefore in general, this control value is successively learned and stored as a learning value, and this learning value is then used as the initial value for controlling, to thus reduce changes in rotation speed at commencement of feedback control of the idle rotation speed.

A system for preventing the discharge of fuel vapor inside a fuel tank into the atmosphere has also been proposed which involves temporarily absorbing the fuel vapor generated inside the fuel tank into a canister (absorption device), and then supplying this to the engine intake system by desorbing and drawing the fuel vapor absorbed into the canister into the engine intake system together with new air using the engine negative intake pressure (refer to Japanese Unexamined Patent Publication No. 62-7962).

If fuel vapor treatment however is carried out during the beforementioned learning for the idle rotation speed, since the air quantity in the desorption gas changes in proportion to the desorption quantity (desorption quantity=air quantity+fuel vapor quantity), this can cause erroneous learning of the learning value.

This erroneous learning can be avoided if the construction is such that fuel vapor treatment is prohibited overall during the learning for the idle rotation speed. However this then gives rise to another problem in that fuel vapor treatment is not expedited.

SUMMARY OF THE INVENTION

In view of the above problems, it is an object of the present invention to provide an apparatus and method for controlling idle rotation speed learning, which can avoid erroneous learning for idle rotation speed, while carrying out fuel vapor treatment to the fullest extent.

To achieve the above object, the apparatus and method according to the present invention for controlling idle rotation speed learning of an internal combustion engine includes, at the time of simultaneous occurrence of a desorption condition where fuel vapor which has been absorbed into an absorption device is to be desorbed together with air into an engine intake system, and a learning condition where a control value for adjusting an intake air flow rate so that an engine idle rotation speed becomes a target rotation speed is to be learnt: prohibiting desorption of the fuel vapor if a concentration of the fuel vapor desorbed into the engine intake system is less than a predetermined value, and carrying out control value learning; and prohibiting the control value learning if the concentration is equal to or above a predetermined value, and carrying out desorption of the fuel vapor.

With such a construction, since in the case where the concentration of the fuel vapor desorbed into the engine intake system is low, the desorption is prohibited and the control value learning is carried out, then the occurrence of learning errors can be prevented. On the other hand, by prohibiting the control value learning when the concentration is high and carrying out desorption of the fuel vapor, then the desorption can be expedited.

Preferably a necessity for desorption of the fuel vapor is judged, and when the necessity is high, the control value learning is prohibited overall and desorption of the fuel vapor is preferentially carried out.

With such a construction, since desorption of the fuel vapor can be carried out irrespective of the desorption concentration, and during this time the control value learning prohibited, then desorption can be expedited by promptly starting desorption when the necessity for desorption is high.

Preferably judgment of the necessity is based on at least one of fuel temperature and engine cooling water temperature.

Since when the fuel temperature or cooling water temperature is high, vaporization of the fuel is considerable, this thus indicates a high necessity for desorption.

Moreover the construction may be such that the necessity is judged based on a cumulative desorption quantity after starting the engine.

In the case where a cumulative value for the desorption quantity from after staring the engine is sufficiently great, then the necessity for desorption is low, while conversely in the case where the cumulative value is small, then the necessity for desorption is high.

In another aspect, with an internal combustion engine constructed such that an air-fuel ratio feedback correction coefficient for correcting the fuel supply quantity to the engine is set so that the air-fuel ratio of the engine combustion mixture approaches a target air-fuel ratio, the construction may be such that the desorption concentration is computed based on a change in the air-fuel ratio feedback correction coefficient caused by executing and stopping the desorption of the fuel vapor.

When the desorption of the fuel vapor is carried out, fuel vapor is supplied to the engine in addition to the normal fuel supplied from the fuel injection valve, thus producing a change in the air-fuel ratio, the change amount corresponding to the desorption concentration. Therefore, since the air-fuel ratio feedback correction coefficient changes corresponding to the change amount of the air-fuel ratio, the desorption concentration can be estimated from the change in the air-fuel ratio feedback correction coefficient.

Preferably when the number of learning cycles for the control value is equal to or above a predetermined value, the learning of the control value is prohibited overall and the desorption of the fuel vapor is preferentially carried out.

More specifically, when the number of learning cycles is equal to or above a predetermined value, it can be assumed that the learning has converged sufficiently and hence execution of the desorption of the fuel vapor is given priority.

Other objects and aspects of the present invention will become apparent from the following description of the embodiments given in conjunction with the appended drawings.

DESCRIPTION OF THE PREFERRED EMBODIMENTS

Figure 1:
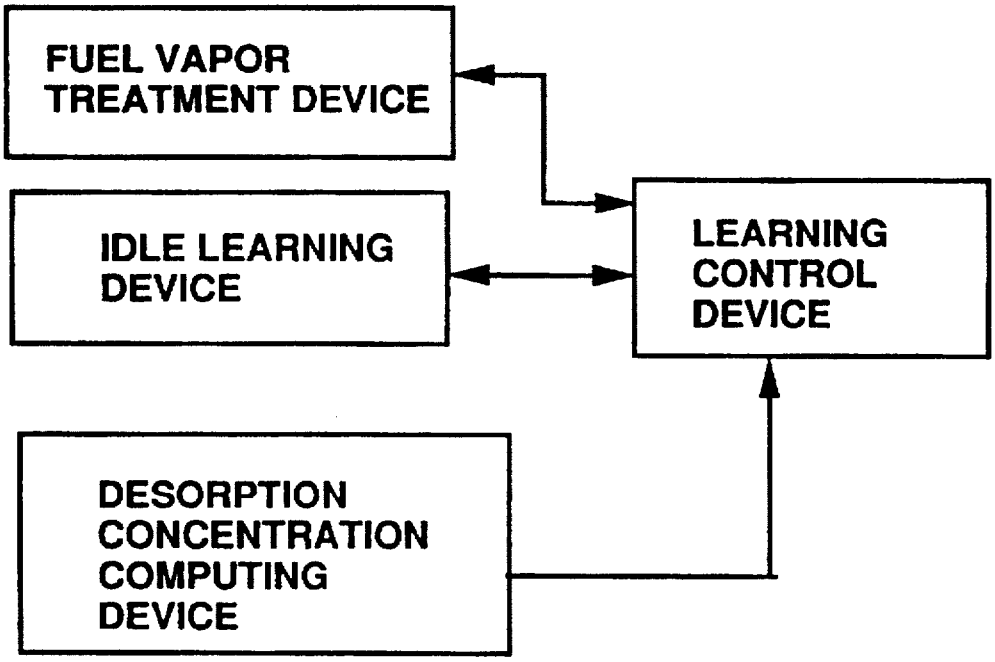
FIG. 1 is a block diagram showing a basic configuration of an idle rotation speed learning control apparatus according to the present invention.

FIG. 1 shows a basic configuration of an idle rotation speed learning control apparatus according the present invention. A fuel vapor treatment device carries out treatment involving absorbing fuel vapor produced in a fuel supply system into an absorption device, and then desorbing this together with air into an engine intake system when a predetermined desorption condition arises. An idle learning device learns a control value for adjusting an intake air flow rate so that an engine idle rotation speed becomes a target rotation speed.

A desorption concentration computing device computes a concentration of the fuel vapor desorbed from the fuel vapor treatment device into the engine intake system.

A learning control device prohibits desorption of fuel vapor by the fuel vapor treatment device and carries out learning of the control value by the idle learning device, if a concentration of fuel vapor computed by the desorption concentration computing device is less than a predetermined value when predetermined learning conditions arise and predetermined desorption conditions arise, and prohibits learning of the control value by the idle learning device, and carries out desorption of fuel vapor by the fuel vapor treatment device if the concentration of fuel vapor is equal to or above a predetermined value when the predetermined learning conditions arise and the predetermined desorption conditions arise.

As follows is a description of a basic embodiment of an idle rotation speed control apparatus and control method for an internal combustion engine, having the above basic construction.

Figure 2:
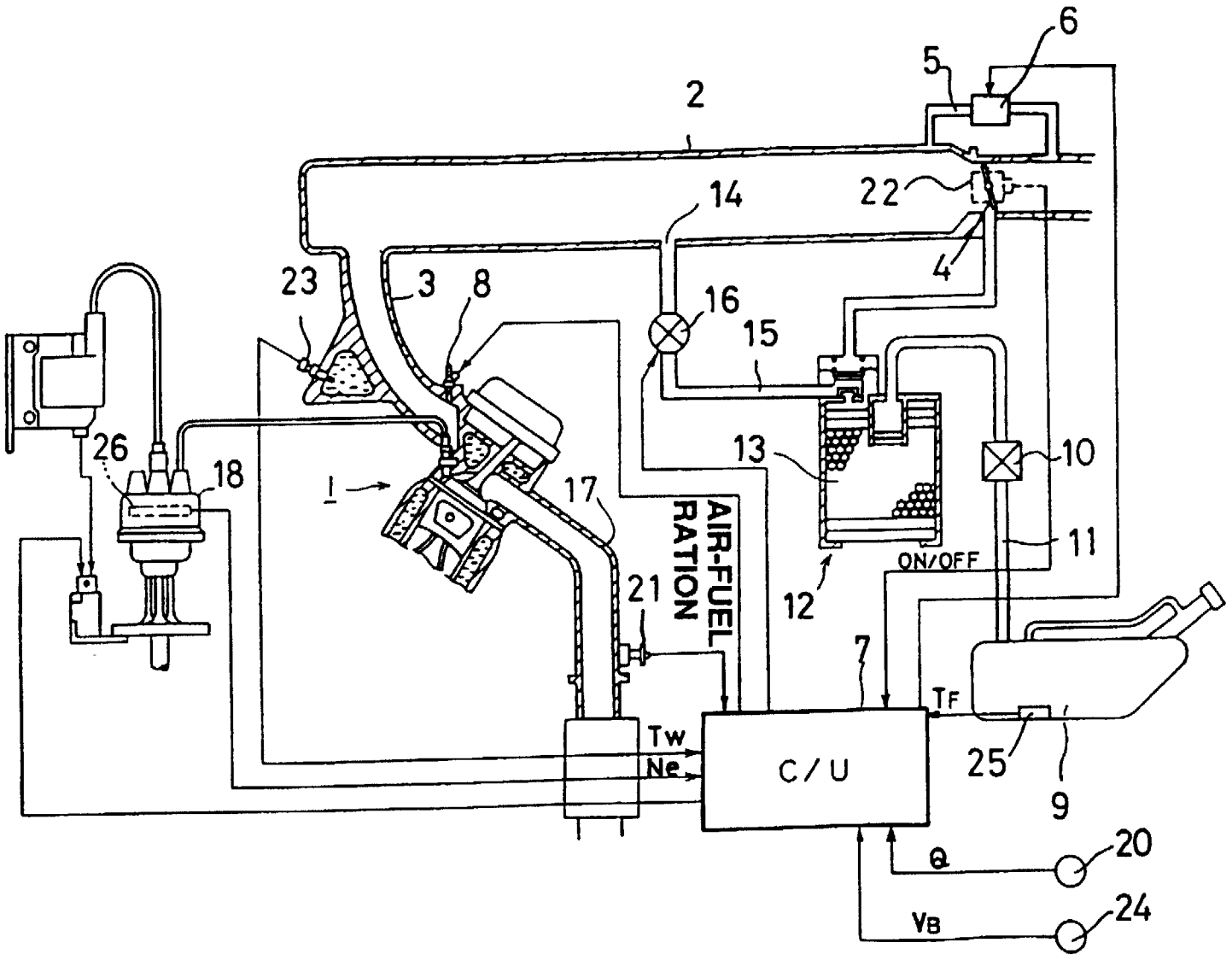
FIG. 2 is a schematic system diagram of an internal combustion engine according to an embodiment.

FIG. 2 shows a system construction of an internal combustion engine according to the embodiment. Air is drawn into an engine 1 via an air cleaner (not shown), an intake duct 2, and an intake manifold 3. A throttle valve 4 linked to an accelerator pedal (not shown), is provided in the intake duct 2 to control an intake air flow rate Q of the engine. An idle control valve 6 is disposed in an auxiliary air passage 5 provided so as to bypass the throttle valve 4.

The idle control valve 6 uses for example a device incorporating a coil for opening the valve and a coil for closing the valve. Drive pulse signals (opening control signals) from a control unit 7 incorporating a microcomputer, are sent to the respective coils in reversed conditions respectively, to thereby control the opening of the idle control valve 6 according to a duty ratio of the drive pulse signals (the proportion (%) of time that power is supplied to the valve open coil). The engine intake air flow rate Q at the time of idling, and hence the idle rotation speed, is thus controlled by the opening.

The intake manifold 3 is also provided with fuel injection valves 8 for injecting fuel to each of the cylinders, driven open by injection pulse signals from the control unit 7.

Moreover with the engine 1 of the present embodiment, a fuel vapor treatment apparatus (fuel vapor treatment device) is provided. More specifically, fuel vapor which accumulates in an upper space of a fuel tank 9 is led to a canister 12 (absorption device) via a fuel vapor passage 11 provided with a check valve 10, and is temporarily absorbed into an absorption medium 13 such as activated carbon inside the canister 12. An upper space of the canister 12 is communicated via a purge line 15 with a purge port 14 formed downstream of the throttle valve 4 in the intake duct 2. A purge control valve 16 which is electrically controlled by the control unit 7, is disposed in the purge passage 15.

To determine the various drive control parameters for the idle control valve 6, the fuel injection valve 8, and the purge control valve 16, signals from various sensors are input to the control unit 7. For these various sensor there is provided for example an air flow meter 20 disposed in the intake duct 2 upstream of the throttle valve 4 for detecting the intake air flow rate Q, an air-fuel ratio sensor 21 disposed in the exhaust passage 17 for detecting the air-fuel ratio of the combustion mixture by detecting the oxygen concentration in the exhaust gas, an idle switch 22 attached to the throttle valve 4, which comes on at the idle position of the throttle valve 4 (fully closed position), a water temperature sensor 23 for detecting the engine cooling water temperature TW, a voltage sensor 24 for detecting the battery voltage VB, and a fuel temperature sensor 25 provided in the fuel tank 9 for detecting the fuel temperature TF.

Moreover, a crank angle sensor 26 is housed in a distributor 18 which distributes a high voltage secondary current to ignition plugs (not shown) provided for each cylinder of the engine 1. The engine rotational speed Ne is detected either by counting in a fixed period the number of unit crank angle signals output from the crank angle sensor 26 synchronously with the engine rotation, or by measuring the period of areference crank angle signal.

The idle control valve 6 in the above described system is feedback controlled by a control signal from the control unit 7 so that the engine rotational speed Ne (idle rotation speed) detected by the crank angle sensor 26 during idling when the idle switch 22 is on, approaches a target rotational speed Ne' which is set based on the cooling water temperature TW detected by the water temperature sensor 23.

Moreover with the feedback control immediately after commencing idling, an amount of air leaking in an initial condition from a gap between the throttle valve and the wall of the intake passage (referred to hereunder as an air leakage quantity), is set beforehand in order to avoid instability of the engine operation attributable to a delay in the feedback control, and a control amount corresponding to this air leakage quantity is subtracted from the opening control amount for the idle control valve 6 to thereby reduce the feedback control amount immediately after commencing idling. In addition, consideration is given for example to dust attaching to the inner wall of the intake passage causing a change in the air leakage quantity, and learning is carried out to update the control value as required, corresponding to this air leakage quantity (idle learning device).

Figure 6:
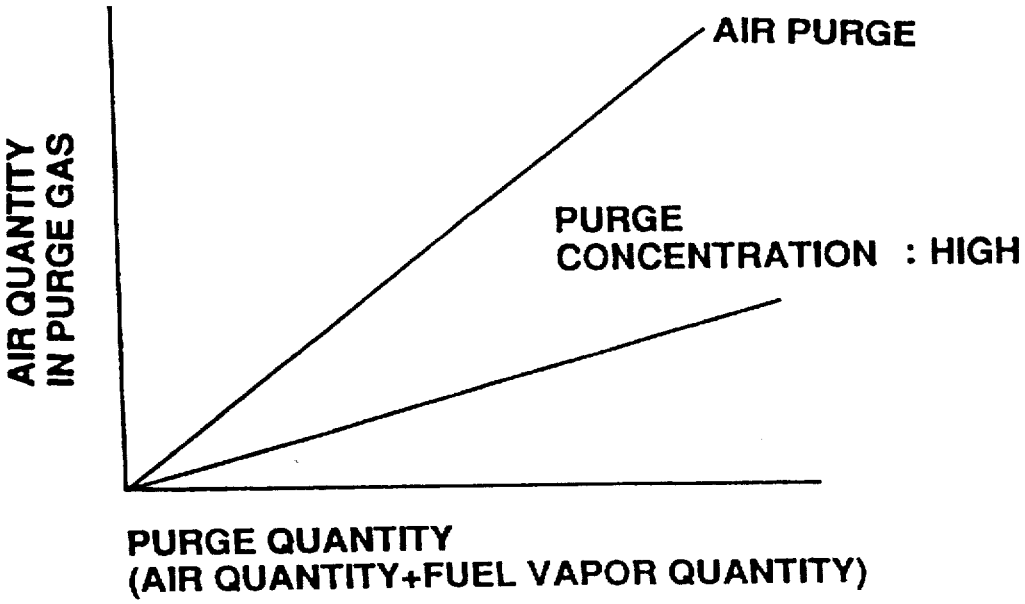
FIG. 6 is a graph showing a relation between desorption quantity and air quantity in the desorption gas.

When this learning for the air leakage quantity is individually carried out, there is no problem. However with fuel vapor treatment, that is, when the fuel vapor absorbed into the absorption medium 13 of the canister 12 is purged, the air quantity in the purge gas changes and can thus cause a learning error in the learning value (refer to FIG. 6).

Figure 3:
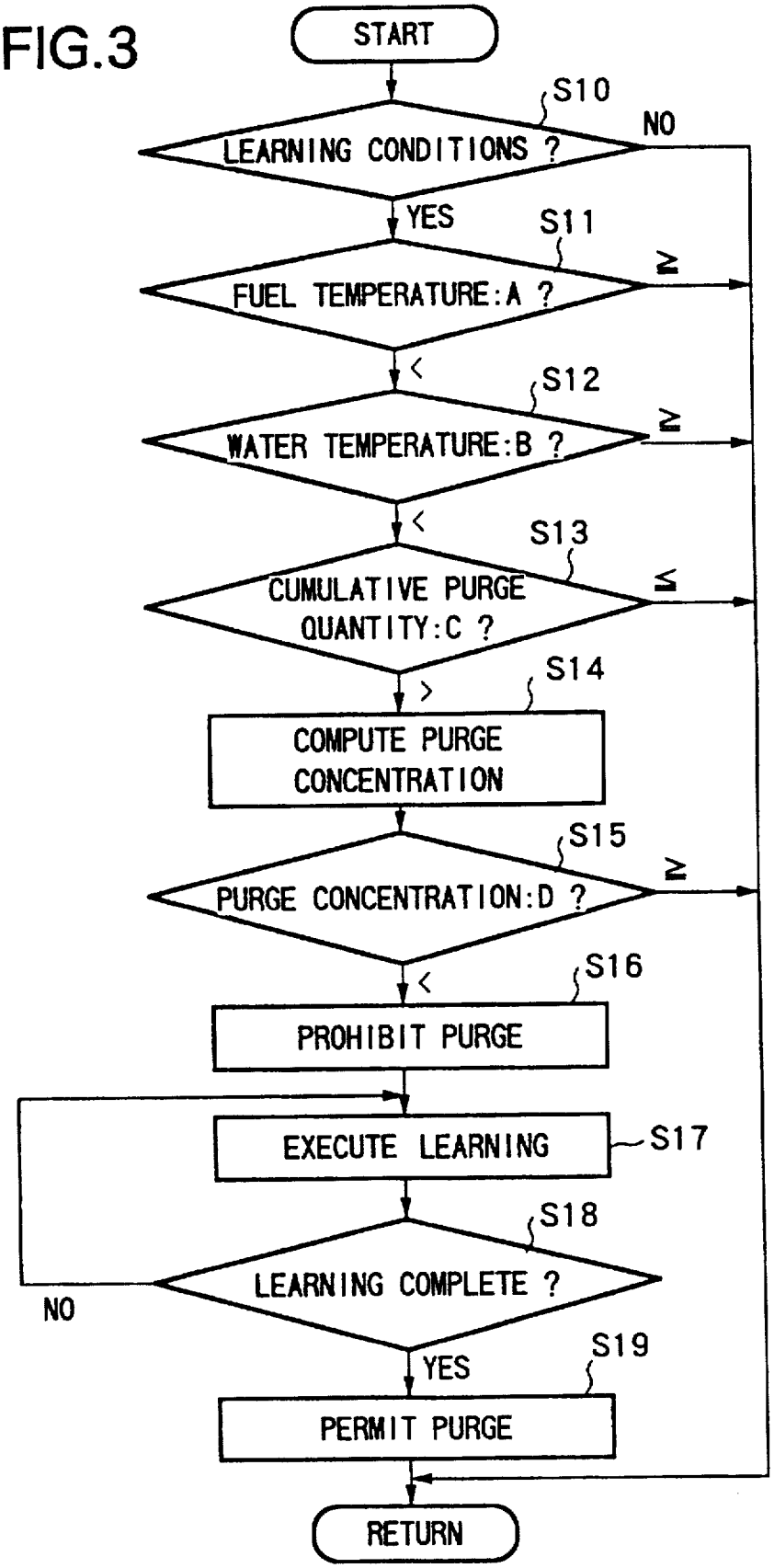
FIG. 3 is a flow chart showing a first embodiment of a learning control routine.

A first embodiment of a learning control routine for the air leakage quantity which overcomes this problem is explained in accordance with the flow chart of FIG. 3. This learning control routine is carried out for each specified time (for example each 100 msec).

In step 10 (denoted by S10 in the figures with subsequent steps indicated in a similar manner), it is judged whether or not conditions for carrying out learning have materialized. Basically learning conditions are judged to have materialized when feedback control of the idle rotation speed is being executed, the cooling water temperature TW detected by the water temperature sensor 23 is equal to or above a predetermined value ($TW \geqq T1$), and the battery voltage VB detected by the voltage sensor 24 is within a predetermined range ($V1 \leqq VB \leqq V2$). More specifically, since the idle rotation speed is considered to be stable under conditions where engine warm up is completed and the battery voltage is in a stable condition, then only at the time of these conditions is learning carried out.

If the learning conditions have materialized, control proceeds to step 11, while if learning conditions have not materialized, the routine is terminated without carrying out learning.

In step 11, it is judged if the fuel temperature TF detected by the fuel temperature sensor 25 is less than a predetermined value A ($TF<A$). If less than the predetermined value A, control proceeds to step 12, while if equal to or above the predetermined value A, the routine is terminated without carrying out learning. With this treatment it is considered that vaporization of the fuel is minimal when the fuel temperature TF is low. Hence in this case, learning for the air leakage quantity is carried out in preference to purging of the fuel vapor.

In step 12, it is judged if the cooling water temperature TW detected by the water temperature sensor 23 is less than a predetermined value B ($TW<B$). If less than the predetermined value B, control proceeds to step 13, while if equal to or above the predetermined value B, the routine is terminated without carrying out learning. With this treatment also, as with step 11, it is considered that vaporization of the fuel is minimal when the cooling water temperature TW is low. Hence in this case, learning for the air leakage quantity is carried out in preference.

In step 13, it is judged if a cumulative purge quantity after engine start is above a predetermined value C, that is, if the residual quantity of fuel vapor absorbed into the absorption medium 13 of the canister 12 is equal to or less than a predetermined value. Basically, the cumulative purge quantity is estimated based on a control signal from the purge control valve 16. If the cumulative purge quantity is above the predetermined value C (when the residual quantity of fuel vapor is minimal) control proceeds to step 14, while if the cumulative purge quantity is equal to or less than the predetermined value C (when the residual quantity of fuel vapor is great), the routine is terminated. With this treatment, when the residual quantity of fuel vapor absorbed into the absorption medium 13 of the canister 12 is minimal, the air leakage quantity learning is preferentially carried out.

When the process of steps 11 through 13 (desorption necessity judgment device) is carried out, it can be judged if the necessity for carrying out fuel vapor purging is groat great or small. Hence inconvenience due to not carrying out fuel vapor purging, for example overflow of the absorption medium 13 of the canister 12 after engine stop, can be avoided.

That is to say, when the fuel vapor quantity is great, or the residual amount of absorbed fuel vapor is great, the necessity for carrying out purge of the fuel vapor is judged to be high. Hence the learning is prohibited overall and fuel vapor purging is preferentially carried out, so that overflow of the absorption medium 13 is avoided (desorption priority device).

In step 14, the purge concentration is computed based on engine rotational speed Ne obtained from the crank angle sensor 18 and the intake air flow rate Q detected by the air flow meter 20. This involves for example obtaining an engine load TP from the intake air flow rate Q and the engine rotational speed Ne, and then computing purge concentration by retrieving the purge concentration from a map based on the engine load TP and the engine rotational speed Ne. This process corresponds to the desorption concentration computing device.

In step 15, it is judged if the computed purge concentration is less than a predetermined value D. If so, control proceeds to step 16 to prohibit purge so that learning can be carried out. If equal to or above the predetermined value D, the routine is terminated without carrying out learning. Hence learning is prohibited and purge of the fuel vapor is carried out.

This process corresponds to the learning control device, and is for preferentially carrying out learning for the air leakage quantity when the purge concentration is low, and carrying out purge of the fuel vapor in preference to learning when the purge concentration is high.

In step 16, since learning for the air leakage quantity is to be preferentially carried out, purge is prohibited so that purge of fuel vapor is not carried out. Basically, prohibiting purge is realized by a drive signal to the purge control valve 16.

In step 17, learning for the air leakage quantity is carried out. Then in step 18, it is judged if learning for the air leakage quantity has been carried out for a predetermined time or a predetermined number of cycles, that is, if learning has been completed. If learning has not been completed, control returns to step 17 while if learning has been completed control proceeds to step 19. In effect, the process of steps 17 and 18 improves learning accuracy by carrying out learning for the air leakage quantity for a predetermined time (or number of cycles).

In step 19, since the learning for the air leakage quantity has been completed, purge prohibition is released in order to again carry out the purge which was prohibited in step 16.

When the above described learning control routine shown in the flow chart of FIG. 3 is carried out, even under conditions for carrying out fuel vapor purge, if the purge concentration is low, purge is prohibited and learning for the air leakage quantity is preferentially carried out, thus ensuring the opportunity for learning and enabling learning to be carried out to a high accuracy. On the other hand, in the case of high purge concentration, learning is prohibited and purge is carried out, so that overflow of the absorption medium 13 can be avoided.

Moreover, as a secondary effect, since the unnecessary purging of fuel vapor under conditions where purge concentration is low is reduced, then deterioration in drivability and exhaust emissions can also be avoided.

Figure 4:
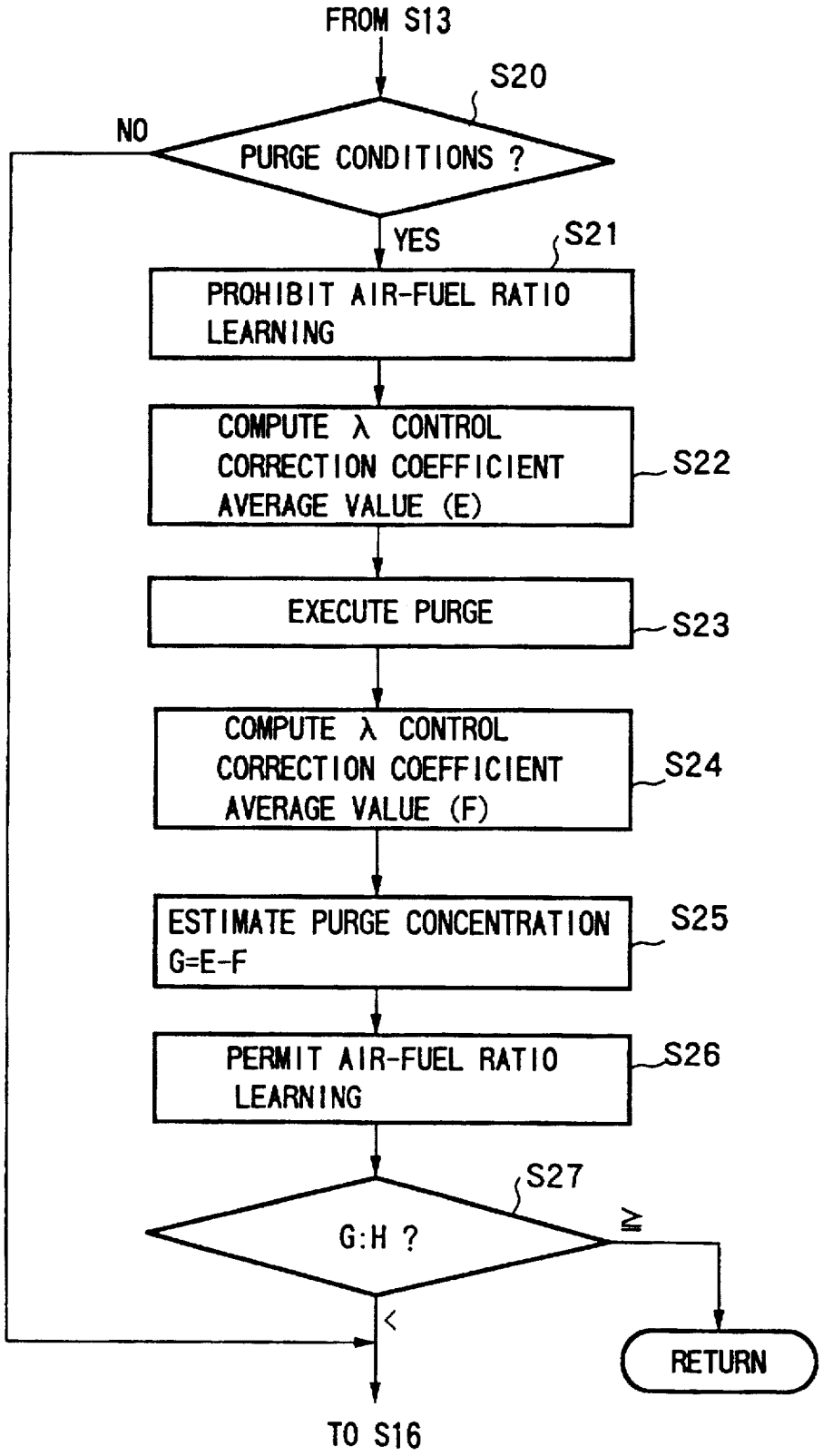
FIG. 4 is a flow chart showing a second embodiment of a learning control routine.

FIG. 4 shows a flow chart for a second embodiment of a control routine for learning air leakage quantity. The computation for the purge concentration in step 14 of FIG. 3 involves observing a change in the air-fuel ratio feedback correction coefficient α caused by the on and off switching of the purge, and obtaining the purge concentration from the deviation of the feedback correction coefficient α when the purge goes from off to on. Here description is only given for the parts different to the flow chart of FIG. 3. For description of the other parts reference should be made to the description for the flow chart of FIG. 3.

The air-fuel ratio feedback correction coefficient α is set so that the actual air-fuel ratio detected by the air-fuel ratio sensor 21 becomes a target air-fuel ratio (air-fuel ratio feedback control device) by correcting the fuel injection quantity.

In step 20, it is judged if conditions for purging the fuel vapor have materialized. If so control proceeds to step 21, while if not control proceeds to step 16.

In step 21, before investigating how the air-fuel ratio feedback correction coefficient α changes due to the on and off switching of the fuel vapor purge, the air-fuel ratio learning is prohibited so as to prevent erroneous learning for the air-fuel ratio. This can be realized for example by changing an air-fuel ratio learning permit flag in an air-fuel ratio learning control programme.

In step 22, an average value E for the air-fuel ratio feedback correction coefficient α within a predetermined time is computed, under conditions with fuel vapor purge not being carried out.

In step 23 fuel vapor purge is then carried out based on engine operating conditions (output signals from the various sensors).

In step 24, an average value F for the air-fuel ratio feedback correction coefficient α within a predetermined time is computed, under conditions with fuel vapor purge being carried out.

In step 25, a difference G (G=E−F) of the average values for the air-fuel ratio feedback correction coefficient α which have been changed by the on and off switching the fuel vapor purge is computed.

In step 26, the air-fuel ratio learning prohibition applied in step 21 is released in order to again carry out the air-fuel ratio learning.

In step 27, it is judged if the difference G of the average values for the air-fuel ratio feedback correction coefficients α changed by the on and off switching of the fuel vapor purge is less than a predetermined value H. If less than the predetermined value H, then it is judged that the purge concentration is less than a predetermined value and control proceeds to step 16, while if equal to or above the predetermined value H, it is judged that the purge concentration is greater than the predetermined value, and the routine is terminated without carrying out learning.

When the learning control as illustrated by the flow chart of FIG. 4 is carried out as described above, then when the fuel vapor purge conditions have materialized, actual purge is carried out and purge concentration computed. Then based on the purge concentration, it is judged whether or not to carry out learning for the air leakage quantity. Therefore the learning for the air leakage quantity can be accurately carried out, while effectively purging the fuel vapor absorbed into the absorption medium in the canister.

Figure 5:
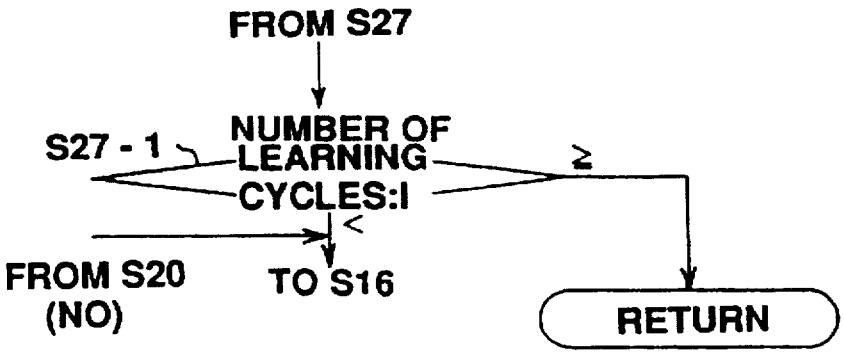
FIG. 5 is a flow chart showing a third embodiment of a learning control routine.

FIG. 5 shows a flow chart for a third embodiment for controlling learning for the air leakage quantity, being a further improvement on the second embodiment shown in FIG. 4. With this embodiment a process is added after step 27 in the flow chart of FIG. 4. Other details are the same as for the beforementioned arrangement, and hence description is here omitted and only the added process is described.

In step 27-1, the number of learning cycles for the air leakage quantity after starting the engine 1 is examined, and if the number of learning cycles is equal to or above a predetermined number of cycles 1 (number of learning cycles: high), then the routine is terminated to give priority to carrying out fuel vapor purge (desorption priority device based on number of learning cycles), while if less than the predetermined number of cycles 1 (number of learning cycles: low) then control proceeds to step 16 to give priority to carrying out learning for the air leakage quantity. To determine the number of learning cycles for the air leakage quantity, for example a timer may be provided, having a value which is reset to zero at the time of starting the engine 1, and which is increased for each time learning is carried out.

When the above described learning control routine shown in the flow chart of FIG. 5 is carried out, then when conditions are for carrying out fuel vapor purge, then even if the purge concentration is low, if the number of learning cycles is great, fuel vapor purge is preferentially carried out instead of learning. Therefore fuel vapor purge can be effectively carried out while maintaining the accuracy of learning for the air leakage quantity. In other words, the residual amount of fuel vapor absorbed into the absorption medium in the canister can be effectively reduced, and hence overflow of the canister after stopping the engine can be avoided.

We claim:

1. An apparatus for controlling idle rotation speed learning of an internal combustion engine, said apparatus comprising:

fuel vapor treatment means for carrying out treatment involving absorbing fuel vapor produced in a fuel supply system into an absorption means, and then desorbing this together with air into an engine intake system, when a predetermined desorption condition arises;

idle learning means for learning a control value for adjusting an intake air flow rate so that an engine idle rotation speed becomes a target rotation speed;

desorption concentration computing means for computing a concentration of the fuel vapor desorbed from said fuel vapor treatment means into the engine intake system;

learning control means, for prohibiting desorption of fuel vapor by said fuel vapor treatment means and carrying out learning of said control value by said idle learning means, if a concentration of fuel vapor computed by said desorption concentration computing means is less than a predetermined value when predetermined learning conditions arise and predetermined desorption conditions arise, and prohibiting learning of said control value by said idle learning means, and carrying out desorption of fuel vapor by said fuel vapor treatment means if said concentration of fuel vapor is equal to or above a predetermined value when said predetermined learning conditions arise and said predetermined desorption conditions arise;

fuel vapor quantity judgment means for judging a condition in which a fuel vapor generation quantity is equal to or greater than a predetermined quantity; and desorption priority means for giving priority over said learning control means, to prohibit overall said control value learning by said idle learning means when said fuel vapor quantity judgment means judges that the fuel vapor generation quantity is equal to or greater than the predetermined quantity, and preferentially carry out desorption of fuel vapor by said fuel vapor treatment means.

2. An apparatus for controlling idle rotation speed learning of an internal combustion engine according to claim 1 further comprising:

cumulative desorption quantity estimation means for estimating a cumulative desorption quantity after starting the engine; and said desorption priority means further prohibits overall said control value learning by said idle learning means when the cumulative desorption quantity estimated by said cumulative desorption quantity estimation means is equal to or less than a predetermined quantity, to preferentially carry out desorption of fuel vapor by said fuel vapor treatment means.

3. An apparatus for controlling idle rotation speed learning of an internal combustion engine according to claim 1, wherein said fuel vapor quantity judgment means judges a condition in which at least one of fuel temperature and engine cooling water temperature is equal to or greater than a predetermined value as a condition in which the fuel vapor generation quantity is equal to or greater than a predetermined quantity.

4. An apparatus for controlling idle rotation speed learning of an internal combustion engine according to claim 1, wherein with an internal combustion engine provided with an air-fuel ratio feedback control means for setting an air-fuel ratio feedback correction coefficient for correcting the fuel supply quantity to the engine so that the air-fuel ratio of the engine combustion mixture approaches a target air-fuel ratio, said desorption concentration computing means carries out said desorption concentration computation based on a change in said air-fuel ratio feedback correction coefficient caused by executing and stopping the desorption of the fuel vapor by said fuel vapor treatment means.

5. An apparatus for controlling idle rotation speed learning of an internal combustion engine according to claim 1, wherein there is provided desorption priority means based on the number of learning cycles for giving priority over said learning control means, to prohibit overall said control value learning by said idle learning means when the number of learning cycles judged by said idle learning means is equal to or above a predetermined value, and preferentially carry out desorption of the fuel vapor by said fuel vapor treatment means.

6. A method of controlling idle rotation speed learning of an internal combustion engine including, at the time of overlapping of a condition where fuel vapor which has been absorbed into an absorption means is to be desorbed together with air into an engine intake system, and a condition where a control value for adjusting an intake air flow rate so that an engine idle rotation speed becomes a target rotation speed is to be learnt:

prohibiting desorption of the fuel vapor if a concentration of the fuel vapor desorbed into said engine intake system is less than a predetermined value, and carrying out control value learning;

prohibiting said control value learning if said concentration is equal to or above a predetermined value, and carrying out desorption of the fuel vapor; and judging a condition in which a fuel vapor generation quantity is equal to or greater than a predetermined quantity and, when the fuel vapor generation quantity is equal to or greater than the predetermined quantity, prohibiting overall said control value learning and preferentially carrying out desorption of fuel vapor by said fuel vapor treatment means.

7. A method of controlling idle rotation speed learning of an internal combustion engine according to claim 6 including; estimating a cumulative desorption quantity after starting the engine, and when the cumulative desorption quantity after starting the engine is equal to or less than a predetermined quantity, prohibiting overall said control value learning and preferentially carrying out desorption of the fuel vapor.

8. A method of controlling idle rotation speed learning of an internal combustion engine according to claim 6, wherein said fuel vapor generation quantity is judged as being equal to or greater than a predetermined quantity based on a condition in which at least one of fuel temperature and engine cooling water temperature is equal to or greater than a predetermined value.

9. A method of controlling idle rotation speed learning of an internal combustion engine according to claim 6, wherein with a construction such that an air-fuel ratio feedback correction coefficient for correcting the fuel supply quantity to the engine is set so that the air-fuel ratio of the engine combustion mixture approaches a target air-fuel ratio, the desorption concentration is computed based on a change in the air-fuel ratio feedback correction coefficient caused by executing and stopping desorption of the fuel vapor.

10. A method of controlling idle rotation speed learning of an internal combustion engine according to claim 6, wherein when a number of learning cycles for said control value is equal to or above a predetermined value, learning of said control value is prohibited overall, and said desorption of the fuel vapor is preferentially carried out.

* * * * *